United States Patent [19]

Canfield

[11] 4,233,520

[45] Nov. 11, 1980

[54] ELECTRO OPTICAL CONTROL TO DETECT A FILAMENT PASSING THROUGH A GUIDE EYE AND USING A LIGHT EMITTING DIODE

[75] Inventor: Sheldon A. Canfield, Newark, Ohio

[73] Assignee: Owens-Corning Fiberglas Corporation, Toledo, Ohio

[21] Appl. No.: 940,068

[22] Filed: Sep. 7, 1978

[51] Int. Cl.[3] ..... G01N 21/86

[52] U.S. Cl. ..... 250/561; 57/81; 356/238

[58] Field of Search ..... 250/561; 356/238; 57/79, 81; 242/37 R; 19/0.21, 0.25; 28/187; 66/161; 139/273A

[56] References Cited

U.S. PATENT DOCUMENTS

| | | | |
|---|---|---|---|
| 3,099,829 | 7/1963 | Namenyi-Katz | 57/81 X |
| 3,391,840 | 7/1968 | King | 250/561 |
| 3,772,524 | 11/1973 | Erbstein | 250/561 |
| 4,112,665 | 9/1978 | Werst | 250/561 X |
| 4,160,360 | 7/1979 | Carvalho | 57/81 |

*Primary Examiner*—David C. Nelms
*Assistant Examiner*—Edward P. Westin
*Attorney, Agent, or Firm*—Ronald C. Hudgens; Charles F. Schroeder; Paul T. Kashimba

[57] ABSTRACT

A guide eye is provided for a filament or strand material. An electro optical control mounted on a guide, to detect the presence of a filament or strand material, has its focus on the inner surface of the guide eye closest to the sensor. Tne filament or strand material moving within the guide eye, causes light to reflect from the sensor light source to the light sensor creating a signal indicating the presence of filament or the strand.

8 Claims, 6 Drawing Figures

ELECTRO OPTICAL CONTROL TO DETECT A FILAMENT PASSING THROUGH A GUIDE EYE AND USING A LIGHT EMITTING DIODE

FIELD OF THE INVENTION

This invention relates to the field of filamentary material detection.

BACKGROUND OF THE INVENTION

The prior art contains numerous examples for detecting a filament or strand as it is being advanced. Many of these prior art devices use a light source and reflected light from the strand to actuate a light sensor and provide a strand presence signal.

One such prior art device is U.S. Pat. No. 4,010,908 which shows a guide for a filament or stand, and a fiber optic system for supplying light to the guide and for receiving light reflected from the strand. Other examples of using reflected light to sense the presence of the strand are shown in U.K. Pat. Nos. 1,124,590, and 779,548 in addition to the prior art cited in U.S. Pat. No. 4,010,908.

However, these prior art patents must flood the filament detection area with light or must force the filament into the detection area either subjecting the system to a low signal to noise ratio in the one case or the filament itself to abrasion in the other case. In addition, these prior art devices require a more powerful light source than the solid state light source used in the invention.

SUMMARY OF THE INVENTION

This invention utilizes an optical sensor unit having a solid state light source and a light detector. The detector and the light source are mounted in the sensor body with the focus of the sensor displaced from the sensor body. The sensitivity or response of the sensor is maximum within the area of focus and substantially zero outside the area of focus. A guide body is provided having a guide opening, and the filament or strand material is passed through the opening. The sensor is mounted relative to the guide with its focus substantially at the inner surface of the guide. The filament or strand passing through the guide may move in any direction within the plane of the guide causing the sensor to produce a signal when the filament or strand intercepts the light beam and reflects that light beam to the sensor light detector.

The output of the sensor is a pulse intermittently generated responsive to the movement of the filament or strand past the focus area of the optical sensor.

A controller is provided, and the light sensor pulse output is connected to the controller along with a suitable clock input. The clock causes the controller to produce an output signal indicating the strand is not present if a signal from the sensor is not received within a predetermined amount of time. If the sensor signal is received within the predetermined amount of time, the sensor output signal resets the controller and starts a new period.

This invention provides two significant advantages.

By providing a sensor with a narrow area of focus at the inside of the guide closest to the sensor, a signal is produced only when the filament moves into the area of focus causing a reflected light signal pulse to be generated by the light detector. This provides an effective means for reducing the total number of pulses produced by the sensor as the focus area is only a small part of the total area within the guide. The smaller number of signals produced has the advantage of a higher signal to noise ratio, because the average signal level relative to the reflected light signal pulse is lower.

Additionally, by using only a small area of focus, a smaller light source can be provided as distinct from the prior art where a large light source, such as an incandescent, was required to flood an entire area. In this case, because only a small area of focus is used, a solid state light source can be used such as an LED. This reduces the energy requirements of the unit and further helps increase the signal to noise ratio.

The guide shown in the preferred embodiment is not essential to the practice of the invention. It is used in the preferred embodiment to mount the sensor. Any other suitable mounting may be utilized to mount the sensor adjacent the strand path.

The means for guiding as shown in the preferred embodiment provides two functions in accomplishing the results of the invention. It serves as a mounting for the sensor and may also constrain the movement of the strand or fiber in a direction generally transverse to its primary direction of travel. The strand or fiber then moves along its primary direction of travel along its length, then also moves in a direction generally transverse to its length, and in and out of the area of focus of the sensor.

However, it should be recognized that the invention may be practiced according to the principles set forth without the particular form of guide shown or without the need for mounting the sensor body within the said guide.

For example, where the transverse movement of the strand or filament is constrained by the nature of the process, the sensor may be placed on any suitable mounting so the focus of the sensor is within the path of transverse movement of the strand or filament and substantially in a region at the outer limit of said constrained transverse movement.

The guide means may be the end terminals of the winding and supply reels or may be guides spatially displaced from the sensor such as rollers or pins for changing the direction of the strand or filament, or may be electrostatic or pneumatic guide means. However, whatever means for guiding are used, the filament or strand, as it moves along its principal direction of movement, will also, and at least randomly and intermittently, pass through the focus of the sensor. It is not necessary for the practice of this invention for the strand or filament to be continuously within the focus as long as it randomly passes through the focus of the sensor with an intermittent frequency high enough to ensure a timely response in the event of a break.

The invention allows the optical sensor to be placed so its focus is intercepted by the filamentary material as it moves along its primary direction and transverse to that primary direction. By using an optical sensor, placed outside the limit of the said transverse movement, but with the focus of the optical sensor within the range of transverse movement, the random and intermittent movement of the material in and out of the area of focus provides a signal. This signal indicates the presence of the strand without the additional energy needed for flooding the area of transverse movement with light or for the need for controlling the light across the strand or for contacting the strand or subjecting the material to electrical fields.

DESCRIPTION OF THE PREFERRED EMBODIMENT

Figure 1:
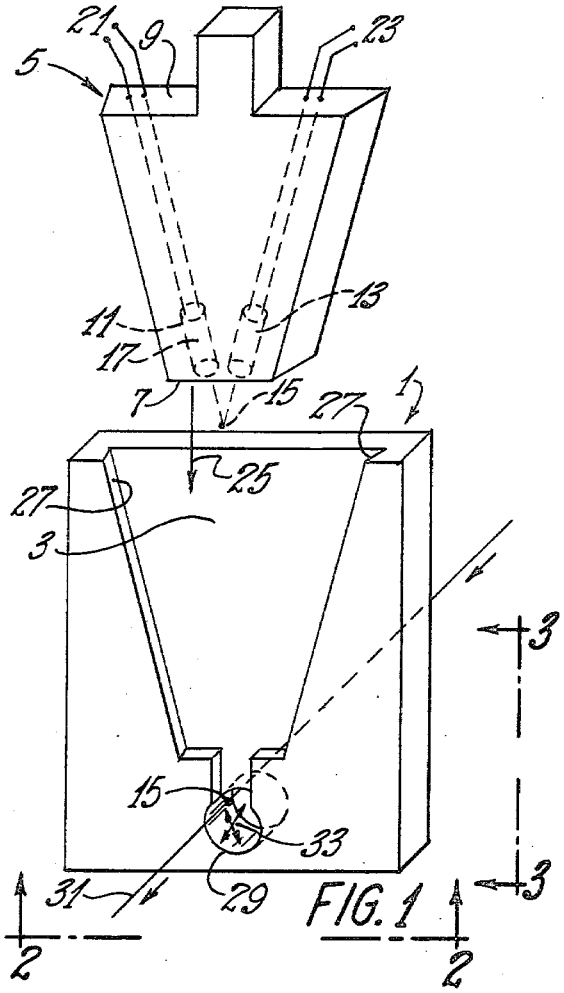
FIG. 1 shows an exploded view of the guide showing the manner in which the sensor unit may be inserted into the guide.

A guide body is shown generally in an exploded view in FIG. 1. A means for guiding 1 has a recessed portion or groove 3 for receiving a sensor 5. The groove 3 is shaped to receive the sensor which has a narrow end at 7 and gradually widens, having a wider end 9. The sensor operating units, including light emitting diode 11 and reflected light detector 13, are placed at the narrow end, having an area of focus and maximum sensitivity 15 displaced slightly from the said narrow end 7. Terminals 21 and terminal pair 23 are connected to the light source and the reflected light sensor for transmitting energy to the light source 17 and receiving signals from the light detector 13. The light sensor body 5 is inserted into the groove 3 in the direction of the arrow 25, and may be held in place by any suitable mounting, such as a screw or other similar arrangement.

The diverging walls of the sensor body 5 are accommodated by the similarly diverging walls 27 of the groove arranged to accommodate and fit the sensor body.

The means for guiding 1 has an opening 29 through which a filamentary or strand material 31 passes. The filament moves in a primary direction 31 along the axis of the opening 29, and also can move in any transvese direction shown by the arrows 33. The focus 15 of the light sensor is shown at substantially the inside surface of the guide opening 29.

Figure 2:
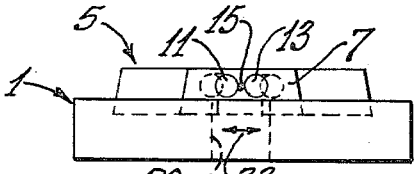
FIG. 2 shows a bottom view of the guide fully assembled along the line 2—2 in FIG. 1.

FIG. 2 shows a bottom view of the assembled guide unit taken along the view 2—2 as shown in FIG. 1. The sensor unit 5 is shown with the light source 11 and the reflected light sensor 13 directed at the inside surface of the guide opening 29 and with its area of focus substantially at the inside surface of the guide opening 29.

Figure 3:
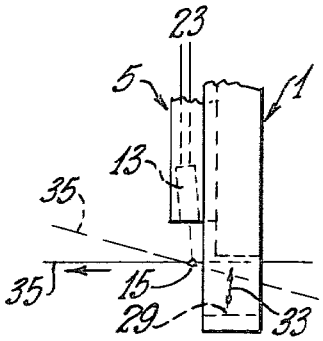
FIG. 3 shows a partial side view of the guide fully assembled along the view line 3—3 shown in FIG. 1.

FIG. 3 shows a partial side view of the sensor along the view taken 3—3 shown in FIG. 1, with the guide fully assembled. The area of focus 15 is shown substantially at the inside surface of the guide opening 29. Filamentary material 35 moves transverse to its direction of principal movement shown by way of arrows 33, intercepts the light source in the area of focus 15 and transmits reflected light to the light detector 13 which then generates an appropriate signal.

Figure 4:
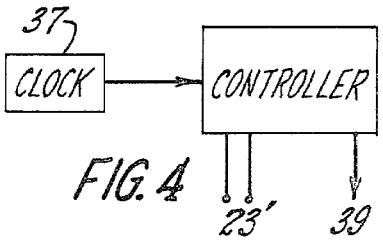
FIG. 4 is a block diagram of a controller which may be used with this invention.

A suitable control for detecting the signal and controlling the process is shown in FIG. 4. A controller is shown having an input 23' for receiving the pulse signal from the reflected light detector 13. A clock 37 provides an input signal to the controller. The controller transmits an output signal indicating that the strand is not present unless a signal is received on terminal pair 23' within a predetermined time duration responsive to clock 37.

Numerous well-known devices may be used. For example, the controller may incorporate a counter which is re-set, by a signal on terminal 23', to a predetermined count, and which is then counted to zero by clock 37 to produce an output signal on line 39 unless re-set within that timed interval by a new signal appearing on line 23'.

Figure 6:
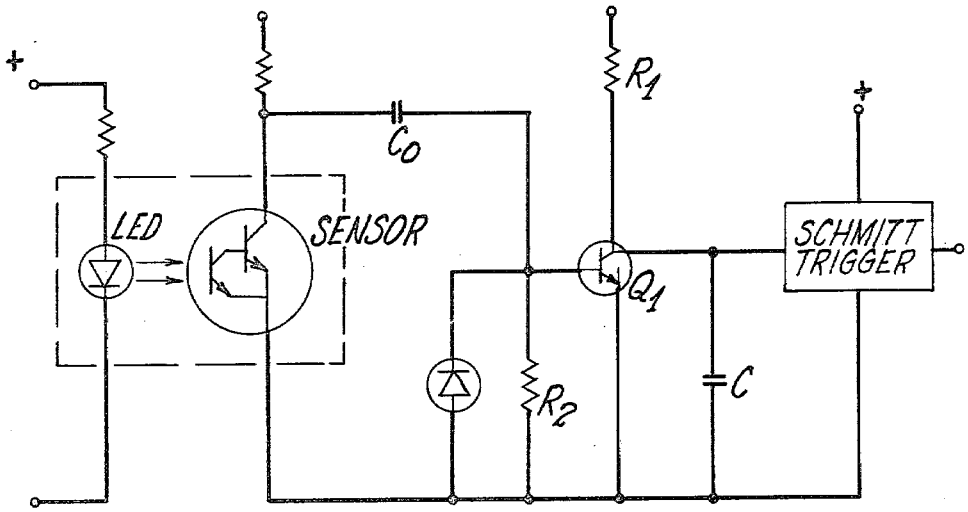
FIG. 6 is the schematic of a particular controller which may be used with this invention.

FIG. 6 shows a particular controller which may be used with this invention. The unit within the dashed lines is the optical sensor consisting of the LED (light emitting diode) and the reflected light sensor. An 82 ohm resistor is shown in series with the power supply to approximate a 40 ma constant current source to the LED. Reflection of light by the strand causes a signal to be generated in the sensor and a pulse input to $Q_1$ turning $Q_1$ on and discharging C. In the absence of a signal from the sensor, C charges, as $Q_1$ is in its Off state. After a time period regulated by the charge time constant RC, C reaches the threshold voltage of the Schmitt Trigger switching its output from a strand presence signal to a strand absence signal.

A suitable sensor which may be used within this device is commercially produced, the Optron OPB-125A.

Figure 5:
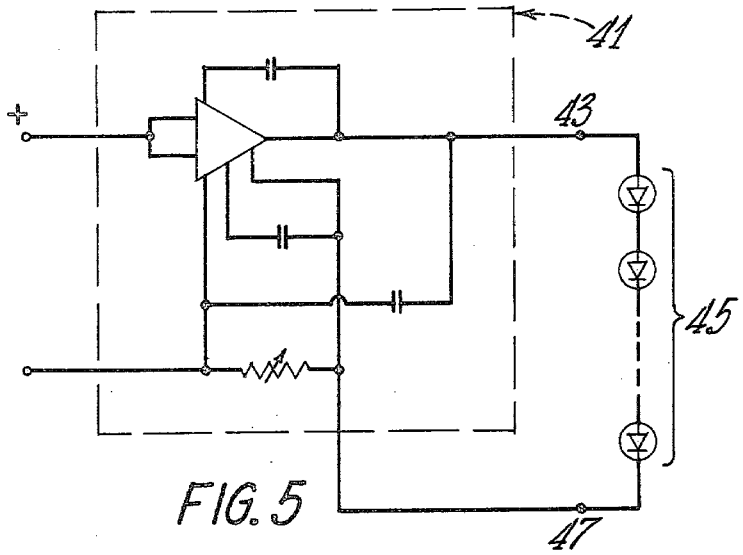
FIG. 5 is a schematic of the manner in which a plurality of light sensors may be connected.

FIG. 5 shows the manner in which this invention may be used, with a plurality of detectors and a plurality of LED light sources connected in series through a constant current source. As shown, a current source 41 is provided as shown within the dashed lines. The output 43 is connected to a number of LEDs in series, shown within the bracket 45 and connected between terminals 43 and 47. The constant current source connected to the LEDs in series, with each LED representing a light source 17 within a sensor 5, provides substantially equal light output from all the light sensors and the maintenance of a substantially uniform response from the plurality of detectors.

The constant current source 41 is shown as an example and is not viewed as limiting the invention, as any constant current source known in the art may be provided. In use, the 35-to-50 ohm variable resistance is adjusted to 40 milliamps under short circuit conditions, so that twelve light-emitting diodes may be supplied in series at a current of 40 milliamps and from a 24-volt DC supply. The constant current source is a commercial unit CA-3085A.

I claim:

1. An apparatus for detecting a continuous filamentary material comprising a means for guiding said material along a primary direction of travel, an optical sensor having a light source and light detector, said means for guiding said material constraining the movement of the said material in a direction generally transverse to its primary direction of travel, said sensor having an area of focus and said sensor being placed adjacent said material and with the said area of focus of the said sensor being substantially at the outer limit of said constrained transverse movement, said detector sensing light from said source reflected from said material when said material enters said area of focus as said material moves within its said transverse direction, and wherein said sensor is substantially insensitive to said reflected light outside the said focus.

2. The apparatus of claim 1 wherein said means for guiding is a body having an opening, and the focus of said sensor is adjacent to the periphery of said opening.

3. The apparatus of claim 2 wherein the sensitivity of the sensor is maximum at the said focus and minimum outside said focus and said sensor detects said filament only when said filament is within the said focus of the sensor.

4. The apparatus of claim 2 or 3, where the opening is substantially larger than the size of said filamentary material.

5. The apparatus of claim 4, wherein said sensor light source is a solid state light source.

6. The apparatus of claim 5, wherein said light source is a light-emitting diode.

7. The apparatus according to claim 6, wherein said sensor has a body with a narrow end and a wider end, said means for guiding includes a groove having a narrow portion at the said inner side of the said opening and a wider portion displaced from said inner side, for receiving said sensor.

8. The apparatus of claim 7 wherein the sensitivity of each said sensor is maximum at the said focus and minimum outside said focus and said sensor detects said filament only when said filament is within the said focus of the sensor.

* * * * *